US006062987A

United States Patent [19]

Woodward

[11] Patent Number: 6,062,987

[45] Date of Patent: May 16, 2000

[54] PLANAR TOP GOLF PUTTER

[76] Inventor: Donald I. Woodward, 44 Seaside Dr., Jamestown, R.I. 02835

[21] Appl. No.: 09/119,120

[22] Filed: Jul. 20, 1998

[51] Int. Cl.[7] ..... A63B 53/02; A63B 53/04

[52] U.S. Cl. ..... 473/251; 473/313; 473/330

[58] Field of Search ..... 473/324, 305, 473/313, 314, 330, 331, 340, 341, 219, 223, 242, 251, 252, 253, 254, 255; D21/736, 741, 742, 743, 744, 745, 746

[56] References Cited

U.S. PATENT DOCUMENTS 3,851,877 12/1974 Giambazi .
5,167,414 12/1992 Montgomery .
5,213,332 5/1993 Fahy .
5,348,295 9/1994 Phillips .
5,482,281 1/1996 Anderson .
5,685,784 11/1997 Butler .
5,718,644 2/1998 Donofrio .
5,746,664 5/1998 Reynolds .

*Primary Examiner*—Sebastiano Passaniti

[57] ABSTRACT

A golf putter featuring a planar top with a sighting groove and a void through which a shaft can be affixed to the club head. The shaft is affixed to a core located in the lower rear portion of the club head. The core is separated by additional material located at the heel and toe ends of the club head. The planar top exists above a curved striking surface, and a bottom portion, which is curved along the longitudinal axis of the club head. The club head is designed to maximize alignment capability in the "address" position, impart a top spin on a struck ball and distribute weight to the bottom center of the club head providing a unique combination of geometry, balance and trajectory characteristics.

7 Claims, 8 Drawing Sheets

PLANAR TOP GOLF PUTTER

BACKGROUND—FIELD OF THE INVENTION

The present invention relates to the club head used in the game of golf specifically an improved club head for putting a golf ball.

BACKGROUND—DESCRIPTION OF PRIOR ART

Putting is an art in the game. The object of the putting club in golf is to maximize control of the struck ball. Putting is one of the more difficult aspects of the game to master. The three most important aspects of putting are club head alignment, club head trajectory and ball trajectory. Club head alignment is the ability of the golfer to align the putter head with respect to the ball in the "address" position. Club head trajectory is the path that the club head travels during the back swing and successive forward swing to make contact with the ball. Ball trajectory is the path of the ball after it has been struck by the club head. Since the game began, there have been continuous attempts to improve putter club head design. Each designer has attempted to provide a putter that will afford the golfer with the greatest control. A number of these designs are training aids for alignment and are not of interest to the present case. Some designs feature greater distribution of weight at each end of the club head, such as U.S. Pat. No. 5,558,332 but does not address the striking face. Other designs such as U.S. Pat. Nos. 5,433,441, 5,354,060 and 5,303,923 have a cylindrical, or semi-cylindrical design that imparts a forward spin on the ball, however, none are designed to maximize the alignment and contact feel of the present invention. Many golfers cannot find a putter that will grant the results that they desire. Therefore, there is a need for a new design. There does not appear to be any putter known which combines the geometry, alignment, and balance and trajectory characteristics achievable with the present invention.

SUMMARY AND OBJECTIVES OF THE INVENTION

The present invention provides an improved putter by optimizing the characteristics of the putter head with respect to alignment, club head trajectory and ball trajectory. Briefly described earlier, alignment refers to the player aligning the club head behind the ball, and perpendicular to the intended path of the ball after it has been struck. This is also referred to as the "address" position in the game. Known previous designs have had a graduated top surface or a top surface that is not flat. The present invention has a planar top surface that exists above the striking surface and by design, does not make contact with the ball. Additionally there is a sighting groove that runs laterally across the entire width of the planar top surface aiding in the alignment process. Another novel feature of the planar top surface is a void allowing the shaft to be affixed to the rear portion of the club head, wherein most designs have the shaft affixed to the top surface. Due to the geometry, location and characteristics of the planar top surface, the average player will be afforded an improved surface to align the club head with the ball in the "address" position, thereby improving the players' chances of sinking the putt.

Club Head Trajectory mentioned earlier, refers to the path of the club head during its path before and after contact with the ball. Putting is the maximization of ball control unlike the swing with the other clubs where distance is the goal. One of the more popular terms currently is "heel and toe weighting". This term refers to the amount of weight that is distributed in the club head. Through various means, the weight of the club head is predominately in the heel and toe areas. The putting swing closely resembles a pendulum, and the claimed heel and toe weighting would allow the club head to remain truer in the swing. The present invention, due to its novel planar top surface, allows the shaft to be affixed to a core located in the rear portion of the club head. This provides the weight to be distributed closer to the center of the club head, and below the contact point of the striking surface. This design feature of the present invention allows the players swing to remain truer to the initial back swing and subsequent forward motion, and allow for longer controlled putting distance with less effort.

Ball Trajectory is the path of the struck ball. Flat striking surfaces or lofted striking surfaces on most prior putter designs have the disadvantage of causing the ball to skid or loft slightly before maintaining contact with the ground as it rolls. This adds to the inconsistency of putting and can be a source of an average player's frustration. Some putter designs as mentioned earlier, have a cylindrical or semi-cylindrical striking surface, which improves the roll of the struck golf ball by imparting a top or forward spin on the ball. While these designs may improve the spin, they create an alignment difficulty of two rounded surfaces contacting each other. Additionally, many designs do not allow for curvature from heel to toe, which can lead to "stubbing" the club head if the swing is even slightly off. The present invention combines the curved striking surface with a planar top surface existing above the striking surface thereby removing the alignment difficulties of two round surfaces contacting each other. Additionally, the present invention provides a bottom surface with a radius of curvature.

The United States Golf Association rules on the designs of clubs, specifically putters include; the shaft or neck or socket of a putter may be fixed at any point in the head. The length from the top of the neck and/or socket to the sole of the club shall not exceed 5 inches (127 mm) measured along the axis of and following any bend in, the neck and/or socket neck. Additionally, the specifications with regard to clubface markings and surface roughness do not apply to putters.

It is the object of the present invention to provide a new putter. Another object of the present invention is to provide a putter with a club head having a unique shape that maximizes the players ball control through improved alignment capabilities. Another object of the present invention is to provide a putter club head that will produce a topspin on a struck golf ball. Another object of the present invention is to provide a putter club head that will be center balanced and allow contact below the center of a golf ball. Another object of the present invention is to provide a putter with a "feel " unlike any previous design.

Other objects and advantages will become apparent from a consideration of the ensuing description and drawings.

Figure 1:
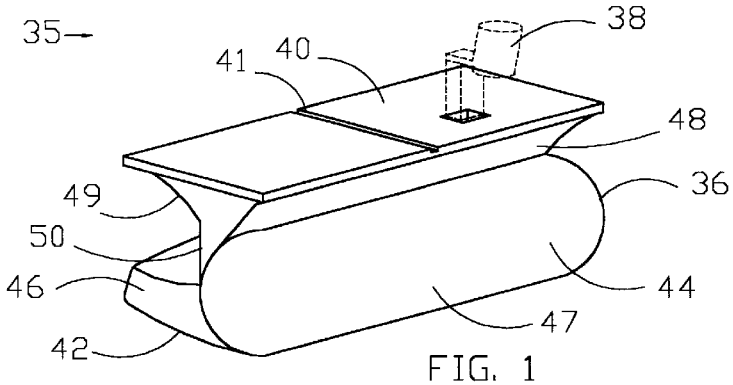
FIG. 1 shows a perspective view of a putter, in accordance with the first preferred embodiment of the invention, with a portion of the shaft cut away and the remainder represented in broken lines.

| Reference Numerals in Drawings |
|---|
| 35 putter |
| 36 head |
| 38 shaft |
| 40 planar top portion |
| 41 sighting groove |
| 42 bottom portion |
| 44 forward portion |
| 46 rear portion |
| 47 curved striking surface |
| 48 forward curved support |
| 49 rearward angled support |
| 50 vertical edge |

-continued

| Reference Numerals in Drawings |
|---|
| 52 void |
| 54 bottom planar surface |
| 56 curved rearward surface |
| 60 rear portion upper planar |
| 62 rear portion rearward edge |
| 64 rear portion cylindrical surface |
| 66 toe end |
| 68 heel end |
| 70 core |
| 72 inside vertical surface rear portion |
| 74 inside vertical surface rear portion |
| 76 rear portion lower planar surface |
| 80 angled planar surface |
| 82 lower planar portion |
| 84 vertical planar portion |

DETAILED DESCRIPTION OF THE PREFERRED EMBODIMENT

Referring in greater detail to the drawings, the reference numerals represent similar components throughout the various views, FIG. 1 shows a perspective view of a putter 35 in accordance with a first preferred embodiment of the present invention. A putter 35 includes a head 36 and a shaft 38. Throughout the views, a portion of a shaft 38 is cut away and represented in broken lines. A head 36 includes a planar top portion 40, a bottom portion 42, a forward portion 44, and a rear portion 46. A planar top portion 40 includes a sighting groove 41, a forward curved support 48 and a rearward angled support 49. A forward curved support 48 culminates at the lower most edge of the top planar portion 40 and upper most edge of the forward portion 44. The rearward angled support culminates at the lower most edge of the planar top portion 40 and a vertical edge 50. A forward portion 44 includes a curved striking surface 47 that intersects with a forward curved support 48 and terminates at the forward edge of a bottom portion 42.

Figure 2:
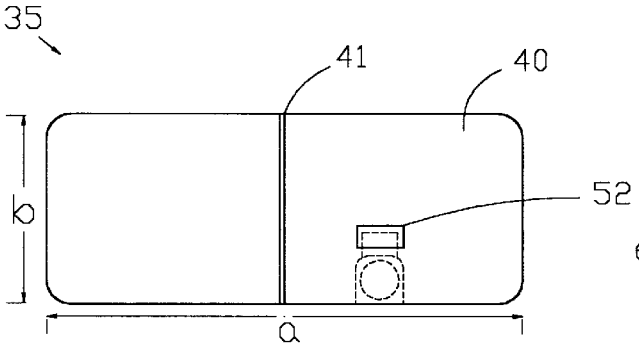
FIG. 2 shows a top view of the putter of FIG. 1.

FIG. 2 shows a top view of a putter 35. A planar top surface 40, which includes a sighting groove 41, also includes a void 52. This void 52 allows a shaft 38 to extend vertically downward through a planar top portion 40 into a putter head 36.

Figure 3:
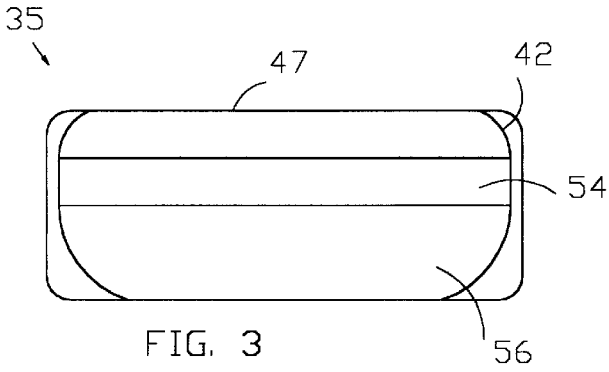
FIG. 3 shows a bottom view of the putter of FIG. 1.

FIG. 3 shows a bottom view of a putter 35. A bottom portion 42 includes the termination of a curved striking surface 47 at a bottom planar surface 54, which is parallel to the longitudinal axis of the head 36, and a curved rearward surface 56.

Figure 4:
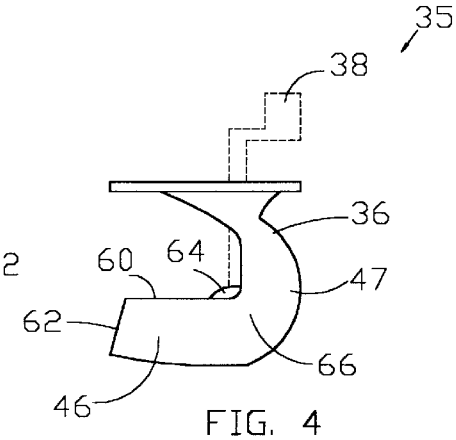
FIG. 4 shows a left side view of the putter of FIG. 1.

FIG. 4 shows a left side view of a putter 35. A rear portion 46 includes an upper planar surface 60, a rearward edge 62, and a generally cylindrical surface 64, that is parallel to the longitudinal axis of a head 36. A cylindrical surface 64 is a receiving point for a shaft 38. A head 36 includes a toe end 66, which is generally rounded and vertical, including the culmination of a curved striking surface 47, and a rear portion 46.

Figure 5:
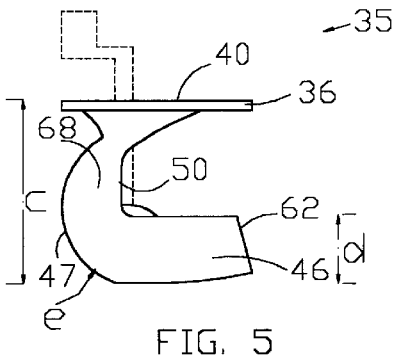
FIG. 5 shows a right side view of the putter of FIG. 1.

FIG. 5 shows a right side view of a putter 35. A planar top portion 40 of a head 36, extends from the vertical edge (vertical tangent line) from a curved striking surface 47 to the vertical edge (vertical tangent line) of the rear portion rearward edge 62. A head 36 includes a heel end 68, which is generally rounded and vertical, including the culmination of a curved striking surface 47, a vertical surface 50 and a rear portion 46.

Figure 6:
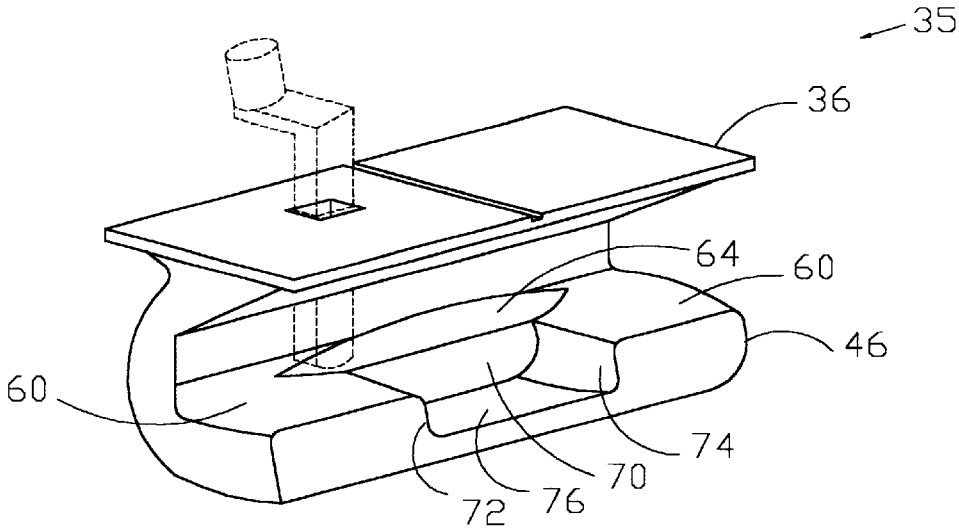
FIG. 6 shows a rear perspective view of a putter, in accordance with the first preferred embodiment of the invention, with a portion of the shaft cut away and the remainder represented by broken lines.

FIG. 6 shows a rear perspective view of a putter 35. A head 36 shows a rear portion 46, including a core 70, which is generally cylindrical along the longitudinal axis, directly below a generally cylindrical surface 64 and culminates at an inside vertical surface 72 and 74 of a rear portion 46. A rear portion 46 includes a lower planar surface 76 that culminates at an inside vertical surface 72 and 74.

Figure 7:
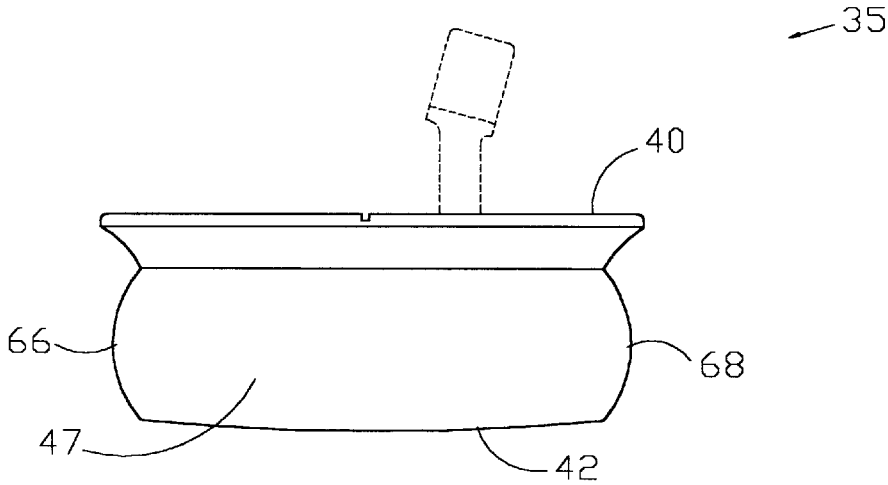
FIG. 7 shows a front view of the putter of FIG. 1.

FIG. 7 shows a front view of a putter 35. A planar top portion 40 longitudinally extends slightly beyond the vertical edges (vertical tangent line) of a toe and heel end 66 and 68. A bottom portion 42 shows the intersection of a curved striking surface 47 with a bottom planar surface 54 additionally curved along the longitudinal axis to the points where it culminates with a toe and heel end 66 and 68.

Figure 8:
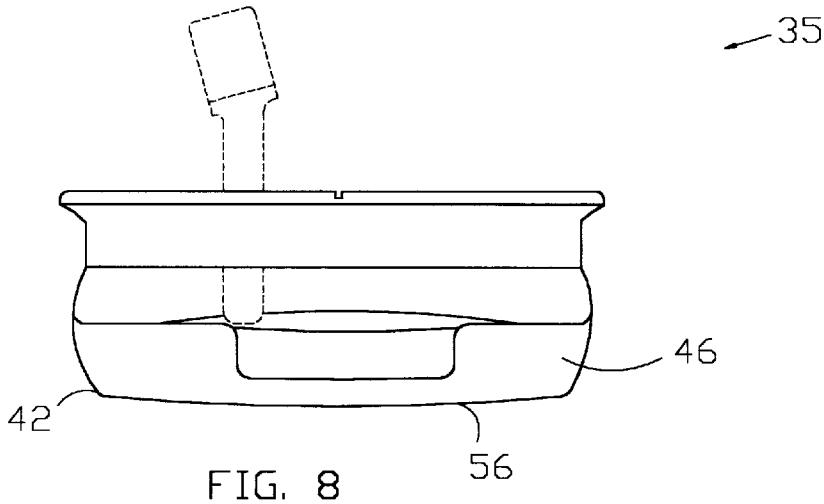
FIG. 8 shows a rear view of the putter of FIG. 1.

FIG. 8 shows a rear view of a putter 35. A bottom portion 42 shows a curved rearward surface 56 additionally curved along the longitudinal axis to the points where it culminates with a rear portion 46.

The use of the present invention, as mentioned earlier is for a putting shot in the game of golf. A player would hold one end of the shaft (not shown in drawing figures) with a grip and the other end would be affixed to a club head. A player would "address" the golf ball and with a pendulum motion, swing the club head back and then forward making contact with the golf ball sending it on its directed trajectory towards the cup. The planar top portion of the club head is generally rectangle, providing a large area of straight edges to align the swing with the ball. Proper alignment during the "address" phase of the swing increases the players' chances of sinking the putt. The sighting groove in the planar top portion spans the width of the club head. A player can improve the club head alignment with the center of the ball and the sighted trajectory line to the cup with this longer sighting line. The planar top portion existing above the striking surface provides depth of perception on the striking edge and the edge of the golf ball. The striking face can not be seen, only the planar top and the golf ball to be struck. With the planar top above the ball covering the club head, the proportion of club head to golf ball has increased. This may create the advantage of less stroke required to propel the ball further, thereby adding additional control to the players putt. The curved striking surface that extends to the intersection of the bottom planar surface allows for a consistent striking edge throughout the height of the striking face. This consistency of shape affords the player the same contact surface, even if the players swing is slightly off center. The curvature of the striking surface creates a contact surface that will allow the struck ball to remain in contact with the ground, eliminating the "skip" or "skid" common to flat striking surfaces. Consistent roll after imparting the ball provides an additional level of consistency for ball trajectory. The core, located at the lower most point of the rear portion provides for "feel" on contact. As the golf ball is struck, the energy is transferred to the core. The uniqueness of the rounded surface directly above the core where the shaft is affixed to the club head allows this energy to be transferred to the shaft and thereby, to the players' hands.

Uniqueness of feel, which is one of the objectives of the present invention, refers not only to the club head when it is held, but also after impact with the ball. Impact "feel" comes as a function of memory. After a short practice session with the present invention, the unique feel will become apparent. Knowledge of this "feel" can build confidence, as the player will be aware of the impact feel required to sink a putt from various distances. Separating the heel and toe ends of the rear portion with a lowered planar surface allows for more material at the ends of the club head. The advantage of this separation is two-fold. More material at each end allows the club head of the present invention to be longer without moving the center of gravity to move off center. The second advantage of the separation is that the core is exposed. Exposing the core on the non-impact side allows the energy to move along the connected surface and to the shaft. The balance of the energy transferred would be into the "dead space" created by the cavity of the lower planar surface the two vertical separations of the rear portion. This contributes to the unique feel mentioned earlier. The bottom portion, having a radius of curvature along the longitudinal axis of the club head can reduce the possibility of "stubbing" the club if the players swing is slightly off. The perfect swing would have the bottom surface barely making contact with the ground surface, but not enough contact to cause resistance. If the players swing is less than perfect, the bottom surface of the present invention would not "stub" on the ground, but slide on top, thereby increasing the players chances making the putt with a less than perfect swing.

The preferred embodiment of the present invention is constructed by conventional means, of; but not limited to, such materials of aluminum, steel, iron, glass, ceramic, composites, or any combination thereof. Conventional means would depend on the material, or materials selected. A preferred method of conventional means would be casting the selected material or materials into a mold. This would create a "rough" of the head that would then be machined to remove any materials not wanted such as the sighting groove, the void in the top planar portion, the cavity in the rear portion, and finishing all surfaces smooth. A shaft, which would be formed independently of conventional means, would then be inserted through the planar top portion an affixed to the putter head by conventional means of attachment.

Referring back to FIG. 2, the following are some acceptable dimensions for the first preferred embodiment of the present invention. The dimension "a", which represents the overall length of the top planar portion can be between 4.75" and 6". The dimension "b", which represents the width of the top planar portion can be between 1.75" and 2.25". Referring back to FIG. 5, the following are some acceptable dimensions for the first preferred embodiment of the present invention. The dimension "c", which represents the overall height of the head 36 can be between 2" and 2.25". The dimension "d" which represents the overall height of the rear portion can be between 0.675" and 0.75". The arc "e" which represents the radius of curvature of the forward portion can be between 0.75" and 0.85". Referring to FIG. 6, the following are some acceptable dimensions for the first preferred embodiment of the present invention. A core 70 can have a diameter between 0.5" and 0.6". A lower planar surface 76 of the rear portion 46 can be between 2" and 3". Referring to FIG. 7, the following are some acceptable dimensions for the first preferred embodiment of the present invention. A bottom portion 42 can have a longitudinal radius of curvature between 22" and 24".

Figure 9:
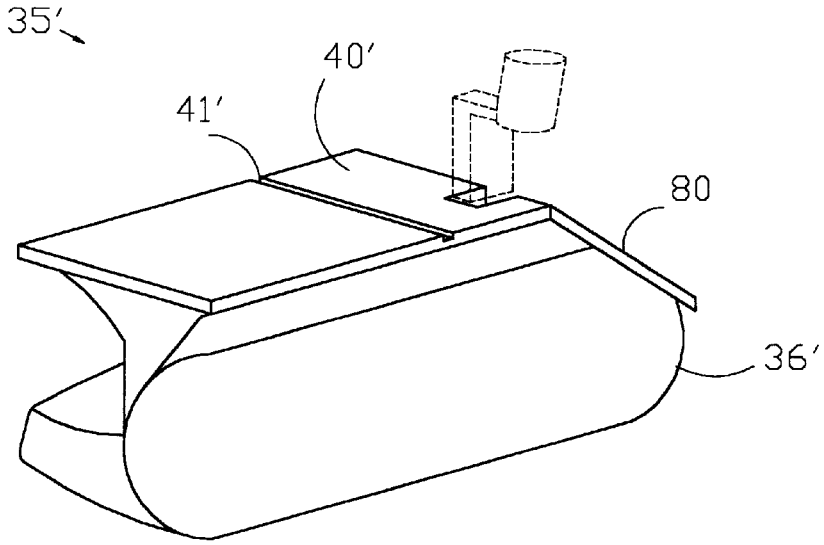
FIG. 9 shows a perspective of a putter, in accordance with the second preferred embodiment of the invention, with a portion of the shaft cut away and the remainder represented in broken lines.
Figure 10:
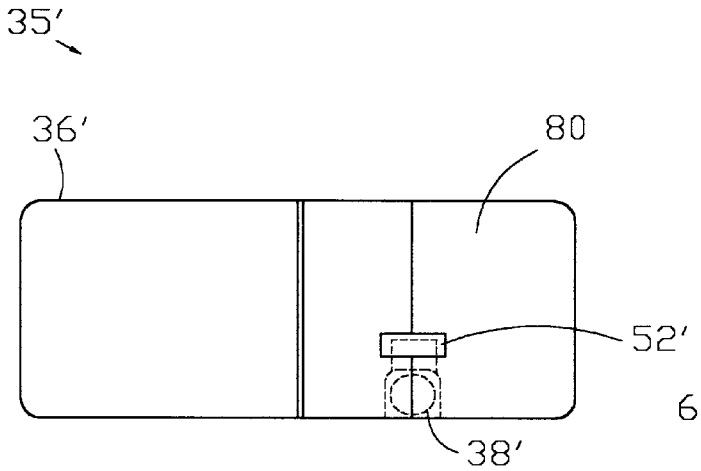
FIG. 10 shows a top view of the putter of FIG. 9.
Figure 11:
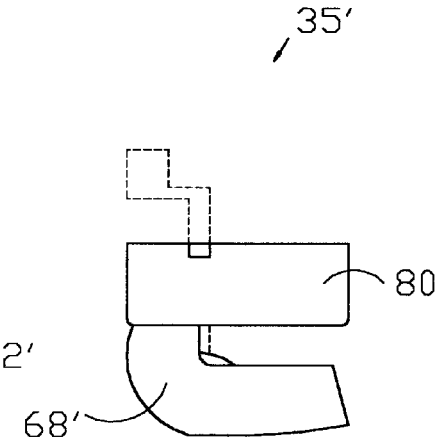
FIG. 11 shows a right side view of the putter of FIG. 9.

FIGS. 9–11 show a putter 35' in accordance with a second preferred embodiment of the present invention.

FIG. 9 shows a perspective view of a putter 35' in accordance with the second preferred embodiment of the invention. The head 36' includes a planar top surface 40' and a sighting groove 41'. The planar top surface 40' includes an angled surface 80 that extends downwards to the heel end 68'.

FIG. 10 shows a top view of a putter 35'. The angled surface 80 of the top planar surface 40' begins approximately the mid point of where the shaft 38' extends vertically downward through the void 52' and into the head 36'.

FIG. 11 shows a right side view of a putter 35'. The angled surface 80 of the planar top portion 40' intersects a vertically reduced heel portion 68'.

The angled surface 80 provides an additional planar surface, which will facilitate various shaft attachments and shapes more readily, further enhancing the application and use. With the exception of the angled surface 80, the putter 35' of the second preferred embodiment is made and used in the same manner as the putter 35 of the first preferred embodiment.

FIGS. 12–19 show a putter 35~ in accordance with the third preferred embodiment of the present invention.

Figure 12:
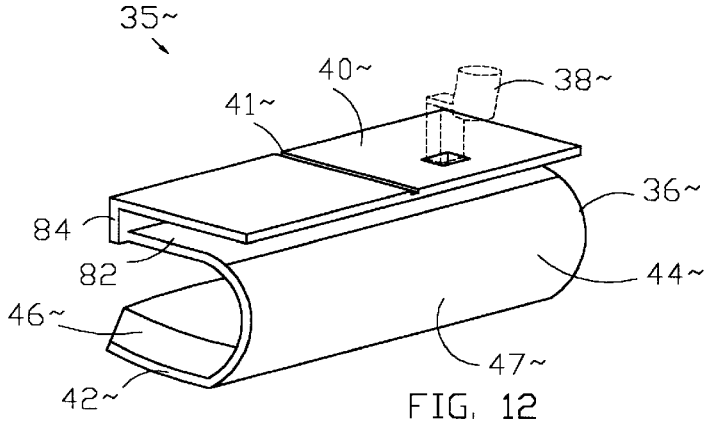
FIG. 12 shows a perspective of a putter, in accordance with the third preferred embodiment of the invention, with a portion of the shaft cut away and the remainder represented in broken lines.

FIG. 12 shows a perspective view, of a putter 35~ which includes a head 36~ and a shaft 38~, that extends upward from a head 36~. A head 36~ includes a planar top portion 40, a bottom portion 42, a forward portion 44~ and a rear portion 46~. Additionally, a head 36~ includes a lower planar portion 82 and a vertical planar portion 84. The planar top portion 40~ includes a sighting groove 41~ and culminates rearward at the uppermost edge of a vertical planar portion 84. A vertical planar portion 84 is parallel to the longitudinal axis of a head 36~ and culminates at the uppermost edge of a lower planar portion 82. A lower planar portion 82 culminates at the intersection of a curved striking surface 47~ of a forward portion 44~. A bottom portion 42~ culminates at the intersection of a curved striking surface 47~, extending rearward to the rearmost edge of a rear portion 44~.

Figure 13:
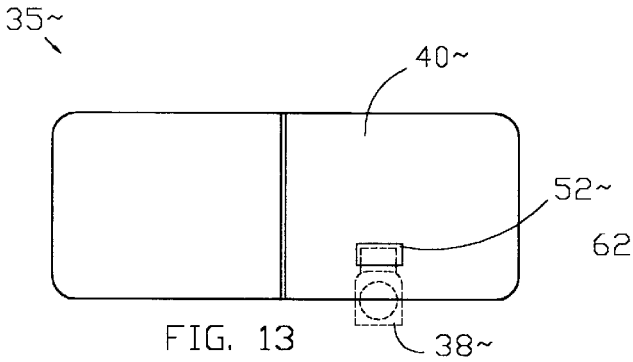
FIG. 13 shows a top view of the putter of FIG. 12.

FIG. 13 shows a top view of a putter 35~. A planar top portion 40~ includes a void 52~. A void 52~ allows a shaft 38~ to extend vertically downward through a planar top portion 40~.

Figure 14:
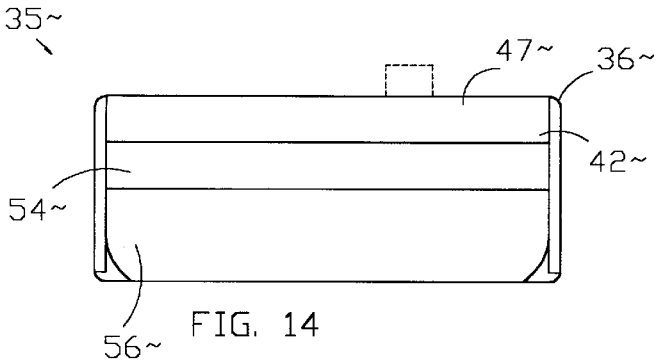
FIG. 14 shows a bottom view of the putter of FIG. 12.

FIG. 14 shows a bottom view of a putter 35~. A bottom portion 42 ~ includes the termination of a curved striking surface 47~ at a planar surface 54~, which is parallel to the longitudinal axis of a head 36~, and a curved rearward surface 56~.

Figure 15:
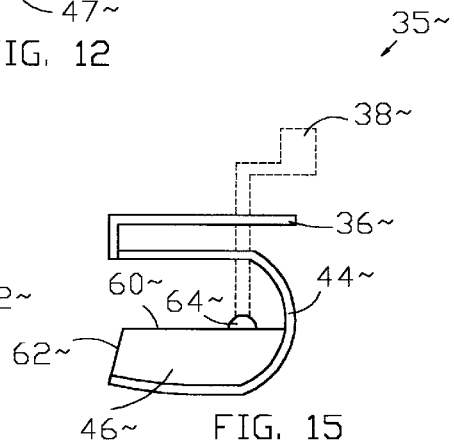
FIG. 15 shows a left side view of the putter of FIG. 12.

FIG. 15 shows a left side view of a putter 35~. A profile of a head 36~ resembles an Arabic numeral "5". A rear portion 46~ culminates at the rear edge of a forward portion 44~ and a rearward edge 62~. A rear portion 46~ includes an upper planar surface 60~, a rearward edge 62~ and a generally cylindrical surface 64~ that is parallel to the longitudinal axis of a head 36. A surface 64~ is a receiving point for a shaft 38~.

Figure 16:
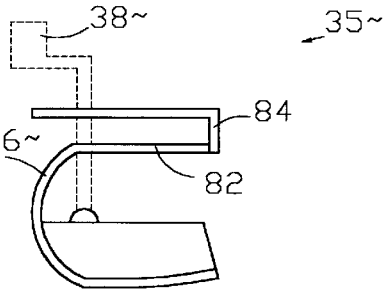
FIG. 16 shows a right side view of the putter of FIG. 12.

FIG. 16 shows a right side view of a putter 35~. A lower planar portion 82 contains a void similar to 52~ in FIG. 13. A void in a lower planar portion 82 allows a shaft 38~ to extend vertically downward into a head 36~.

Figure 17:
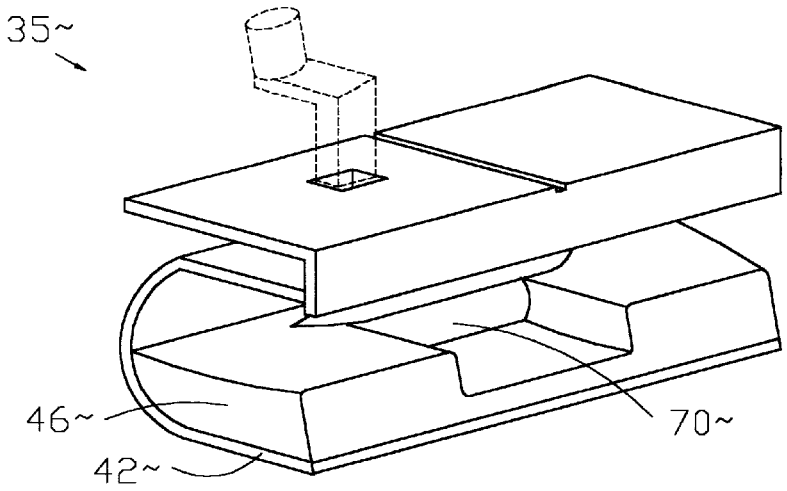
FIG. 17 shows a rear perspective of a putter, in accordance with the third preferred embodiment of the invention, with a portion of the shaft cut away and the remainder represented in broken lines.

FIG. 17 shows a rear perspective view of a putter 35~. A head 36~ shows a rear portion 46~, which includes a core 70~. A rear portion 46~ exists directly above a bottom portion 42~.

Figure 18:
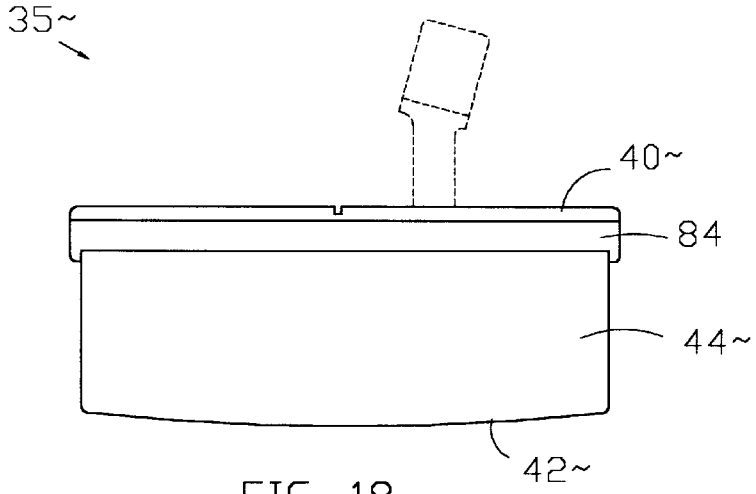
FIG. 18 shows a front view of the putter of FIG. 12.

FIG. 18 shows a front view of a putter 35~. A planar top portion 40~ and a vertical planar portion 84 extend slightly beyond the vertical edges of a forward portion 44~. A bottom portion 42~ shows the longitudinal curvature of the intersection of a curved striking surface 47~.

Figure 19:
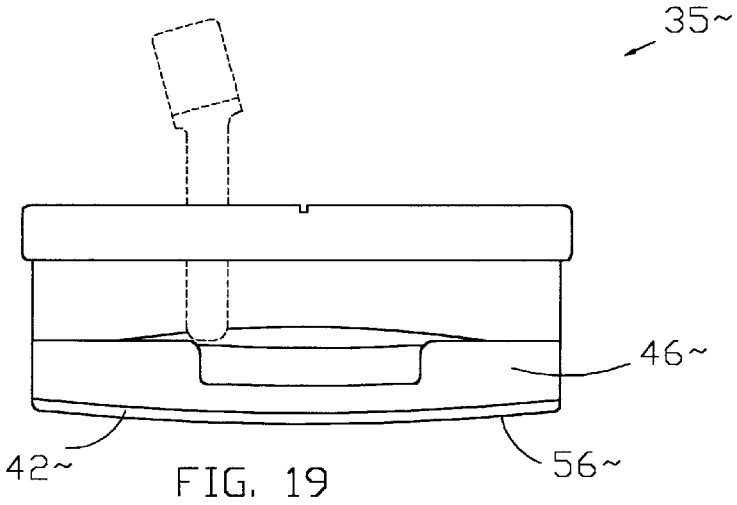
FIG. 19 shows a rear view of the putter of FIG. 12.
Figure 20:
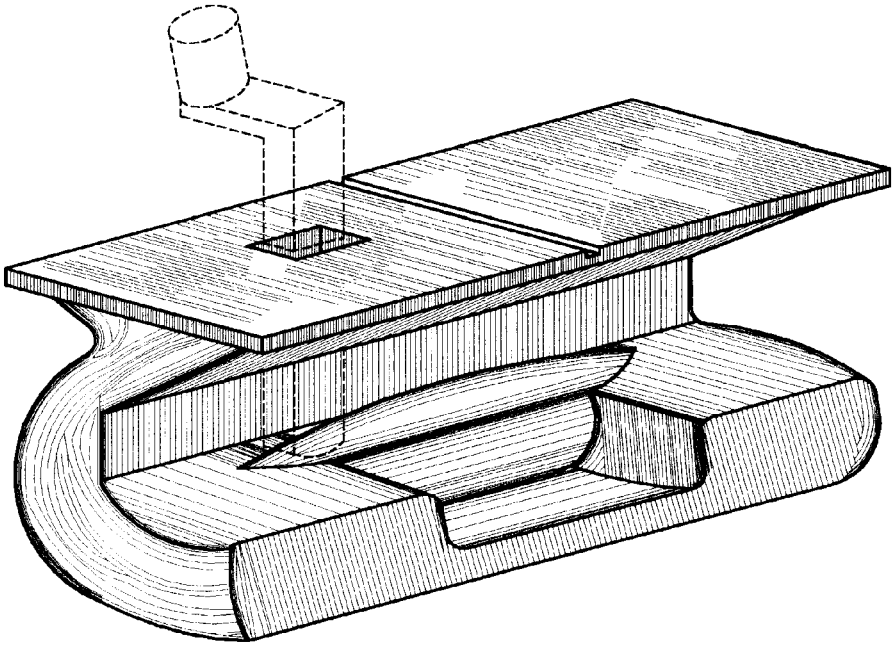
FIG. 20 shows a rear perspective view of a putter, in accordance with the first preferred embodiment of the invention, using line shading, with a portion of the shaft cut away and the remainder represented in broken lines.
Figure 21:
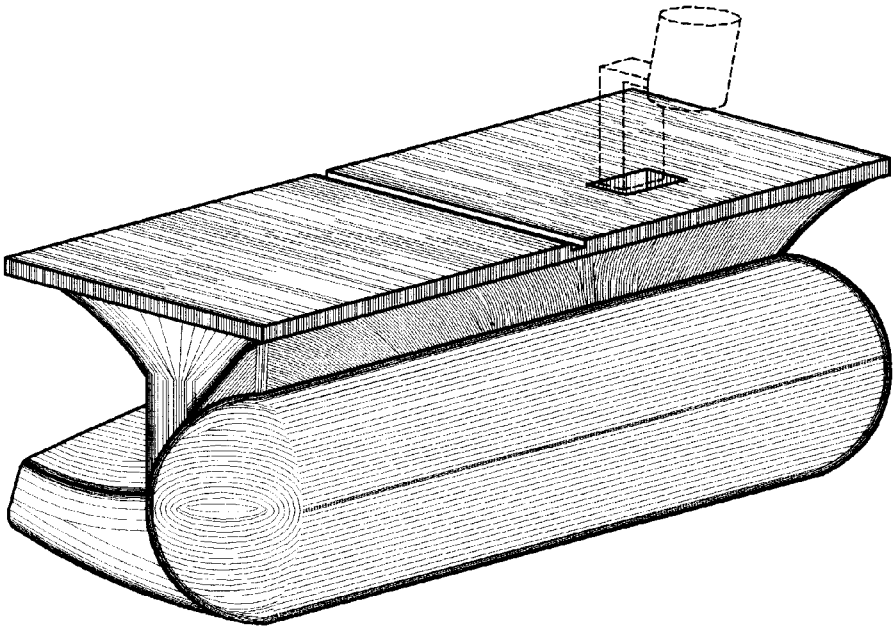
FIG. 21 shows a perspective view of a putter, in accordance with the first preferred embodiment of the invention, using line shading, with a portion of the shaft cut away and the remainder represented in broken lines.
Figure 22:
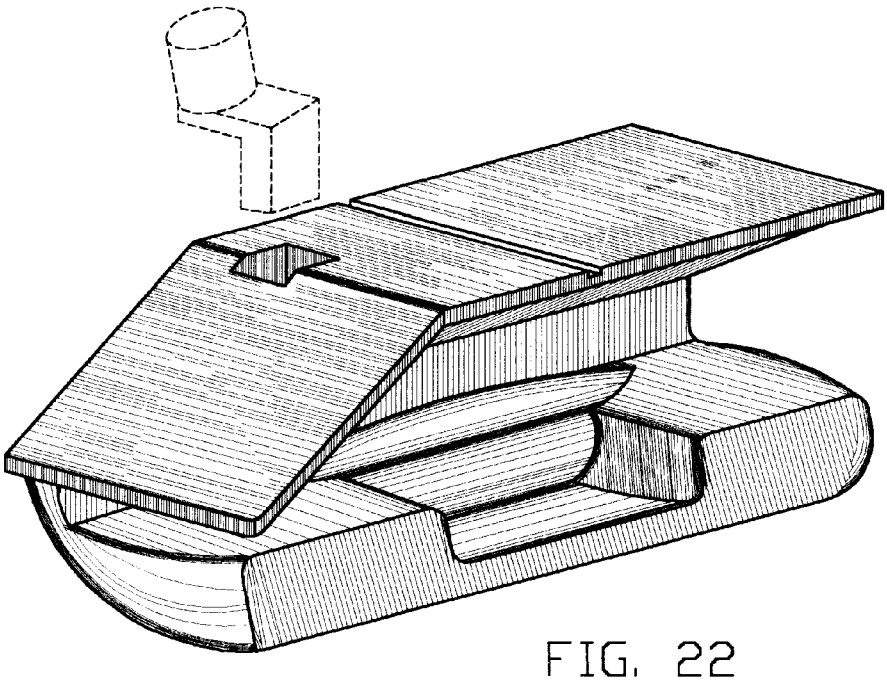
FIG. 22 shows a rear perspective of the putter, in accordance with the second Preferred embodiment of the invention, using line shading, with a portion of the shaft cut away and the remainder represented in broken lines.
Figure 23:
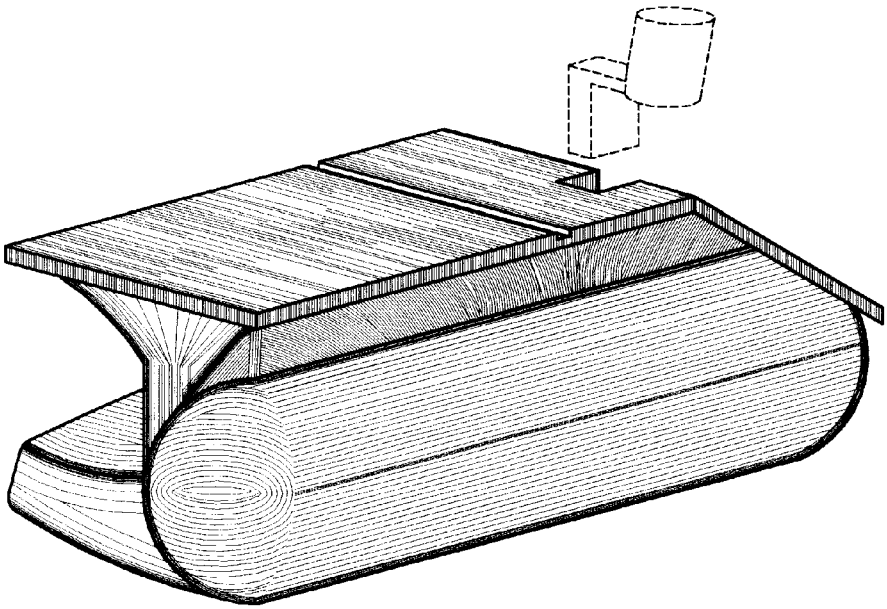
FIG. 23 shows a perspective view of a putter, in accordance with the second preferred embodiment of the invention, using line shading, with a portion of the shaft cut away and the remainder represented in broken lines.
Figure 24:
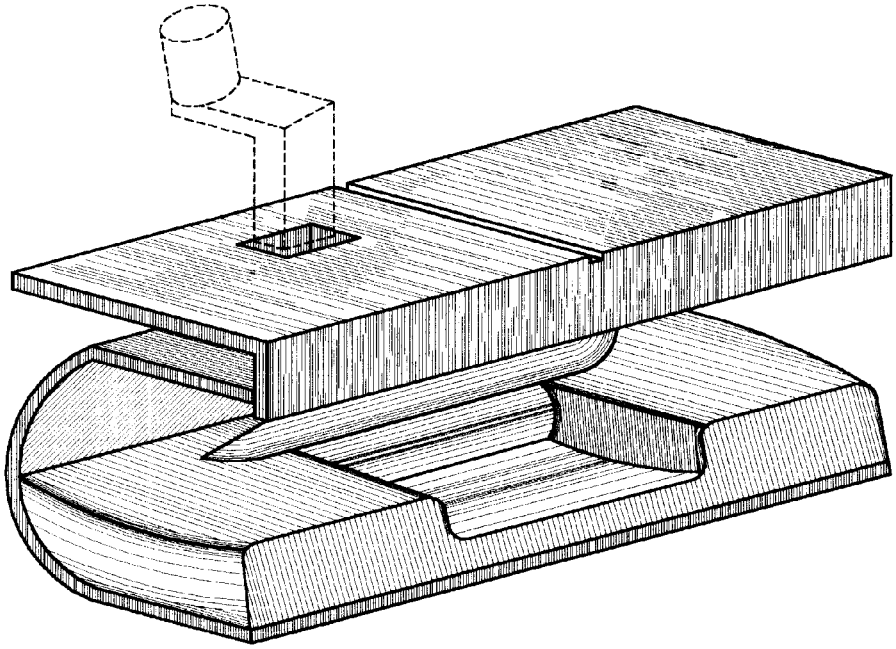
FIG. 24 shows a rear perspective of the putter, in accordance with the third preferred embodiment of the invention, using line shading, with a portion of the shaft cut away and the remainder represented in broken lines.
Figure 25:
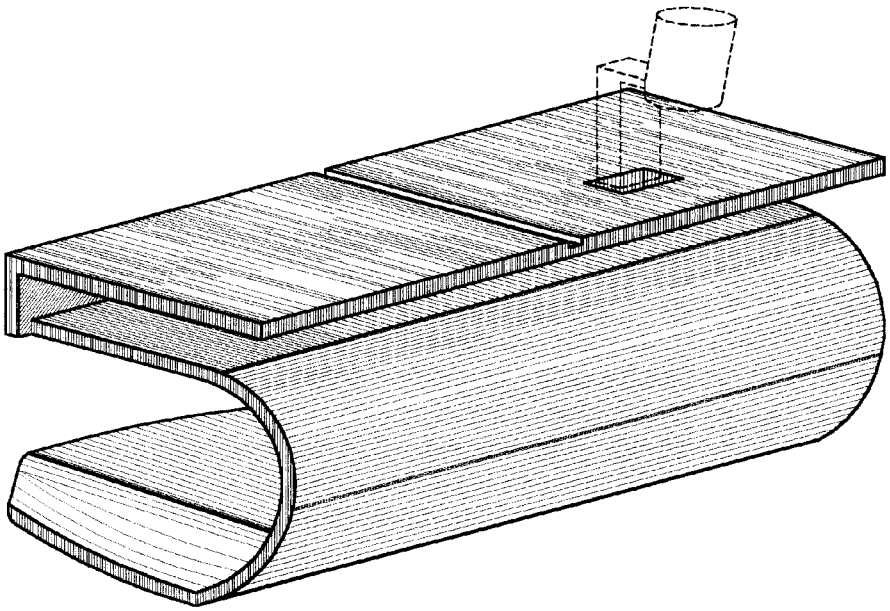
FIG. 25 shows a perspective view of the putter, in accordance with the third preferred embodiment of the invention, using line shading, with a portion of the shaft cut away and the remainder represented in broken lines.

FIG. 19 shows a rear view of a putter 35~. A bottom portion 42~ shows the curved rearward surface 56~ additionally curved along the longitudinal axis to the points where it culminates with the rear portion 46~.

A putter 35~ of the third preferred embodiment is used in the same manner as the putter 35 of the first preferred embodiment and putter 35' of the second preferred embodiment. The difference is in the manufacture of the third preferred embodiment. Using conventional means the putter 35~ is constructed of; but not limited to, such materials as aluminum, steel, iron, glass, ceramic composites or any combination thereof. The head 36~ would be constructed of two parts. The first part would include a planar top portion 40~, a sighting groove 41~, a vertical planar portion 84, a lower planar portion 82, a forward portion 44~, and a bottom portion 42~. These portions would be formed in conjunction. A method of forming could be from a continuous sheet that is pressed and shaped through a series of progressive dies. Another method of forming could be casting using a mold. A rear portion would be formed independently using similar conventional means and materials. The first part would resemble the Arabic numeral "5" as mentioned in FIG. 15. The rear portion would then be affixed to the first part by conventional means. A shaft, formed independently would then be affixed to the head 36~ using conventional means.

Whereas this invention has been described in detail, these should not be construed as limitations on the scope of the invention, but rather as an exemplification of the preferred embodiments thereof Accordingly, the scope of the invention should be determined not by the embodiments illustrated, but by the appended claims and their legal equivalents.

I claim:

1. A planar top golf putter, comprising:

a head, including a planar top portion which includes a single void, a forward portion, a rear portion, a bottom portion; a generally cylindrical core disposed adjacent said rear portion; said cylindrical core including a longitudinal axis in a heel-to-toe direction and;

a shaft having one end extending through said void in said planar top portion and affixed to the cylindrical core in said rear portion.

2. The planar top golf putter of claim 1 wherein the planar top portion is supported by a curved surface adjacent the longitudinal axis, significantly adjacent the forward edge of a curved striking surface, of said forward portion.

3. The planar top golf putter of claim 1 wherein the planar top portion extends laterally from a vertical tangent of a forward edge of a curved striking surface of the forward portion, to a vertical tangent of a rearmost edge of the rear portion.

4. The planar top golf putter of claim 1 wherein the planar top portion extends longitudinally 0.25 inch beyond the ends of the forward, rear and bottom portions.

5. The planar top golf putter of claim 1 wherein the rear portion includes a cavity adjacent a longitudinal axis of said rear portion.

6. A planar top golf putter, comprising:

a head, including a planar top portion which includes a single void, a lower planar portion which includes a void, a forward portion, a rear portion, a bottom portion, a generally cylindrical core disposed adjacent said rear portion; said cylindrical core including a longitudinal axis in a heel-to-toe direction and;

a shaft having one end extending through said void in said planar top portion and said void in said lower planar portion and affixed to the cylindrical core in said rear portion.

7. The planar top golf putter of claim 6 wherein the planar top portion and the lower planar portion are separated by a single vertical planar portion substantially adjacent the rearmost edge of said rear portion.

* * * * *